United States Patent [19]

Boole

[11] 4,061,395

[45] Dec. 6, 1977

[54] PORTABLE DRAWER ASSEMBLY

[76] Inventor: Leon J. Boole, P.O. Box 31, Newtonville, Mass. 02160

[21] Appl. No.: 732,283

[22] Filed: Oct. 13, 1976

[51] Int. Cl.[2] ..... A47C 7/62

[52] U.S. Cl. ..... 297/192; 5/308; 312/205; 312/319

[58] Field of Search ..... 297/192; 312/319, 330, 312/205; 5/308, 324

[56] References Cited

U.S. PATENT DOCUMENTS

| | | | |
|---|---|---|---|
| 726,393 | 4/1903 | Barcalo | 5/308 |
| 1,283,528 | 11/1918 | Kisza | 312/319 |
| 1,289,897 | 12/1918 | Phillips | 5/308 |
| 1,291,794 | 1/1919 | Droste | 5/308 |
| 1,357,951 | 11/1920 | Camenisch | 5/308 |
| 1,917,980 | 7/1933 | Kelsey | 312/205 X |
| 2,272,537 | 2/1942 | West | 312/319 |
| 2,628,145 | 2/1953 | Slattery | 312/205 |
| 2,910,336 | 10/1959 | Mustee | 312/319 X |
| 2,954,568 | 10/1960 | Picht | 5/308 |
| 3,004,267 | 10/1961 | Pesola | 5/308 X |

FOREIGN PATENT DOCUMENTS

| | | | |
|---|---|---|---|
| 339,691 | 12/1930 | United Kingdom | 5/308 |

*Primary Examiner*—Francis K. Zugel
*Attorney, Agent, or Firm*—Allen D. Brufsky

[57] ABSTRACT

A portable drawer assembly for use with a four legged chair or the like having a space between the legs. The assembly comprises an enclosure having an open top and whose width is selectively adjustable to effect the positioning thereof in the space between the four legs. The enclosure is mounted on the four legs for sliding movement into and out of the space between the four legs.

3 Claims, 4 Drawing Figures

PORTABLE DRAWER ASSEMBLY

BACKGROUND OF THE INVENTION

The present invention relates to a portable drawer assembly for use with a four legged piece of furniture having a space between the legs.

Drawer assemblies of this type are known in the prior art, but these assemblies have the disadvantage of having a fixed width and therefore of not being able to optimally use the effective space between the four legs of the piece of furniture and of not being able to be used with a wide range of sizes of furniture.

Among the known prior art drawer assemblies that have these disadvantages are those taught in U.S. Pat. Nos. 210,487; 1,295,043; 1,566,664; 1,928,890; 2,652,887; 2,692,007; 2,765,025; and 3,544,157.

SUMMARY OF THE INVENTION

It is the principal object of this invention to provide a portable drawer that may be adjusted in its width to fit between the four legs of a piece of furniture and be slidably mounted therebetween.

This and other objects are achieved by the preferred embodiment of the present invention in which a drawer or enclosure is formed in two slidably engageable sections that can be selectively adjusted in width for positioning between the legs of the furniture.

The enclosure is slidably mounted to rods mounted to the legs along the length of the enclosure.

Having in mind the above and other objects that will be obvious from an understanding of the disclosure, the present invention comprises a combination and arrangement of parts illustrated in the presently preferred embodiments of the invention which are hereinafter set forth in sufficient detail to enable those persons skilled in the art to clearly understand the function, operation, construction and advantages of it when read in conjunction with the accompanying drawings.

BRIEF DESCRIPTION OF THE DRAWING

The invention will be described in detail, by way of example, with reference to the accompanying drawing in which.

DETAILED DESCRIPTION OF THE INVENTION

Figure 1:
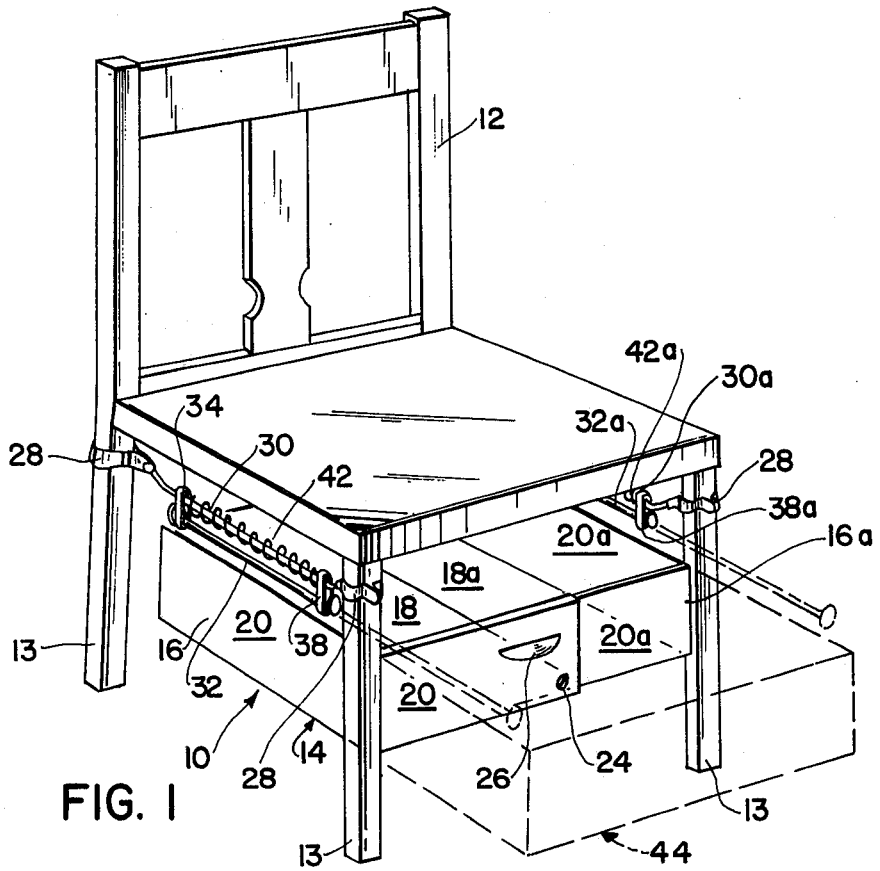
FIG. 1 is a pictorial view of the preferred embodiment.
Figure 3:
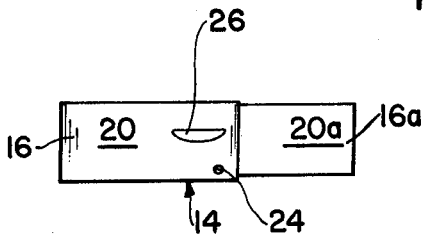
FIG. 3 is a front view of the drawer assembly.
Figure 4:
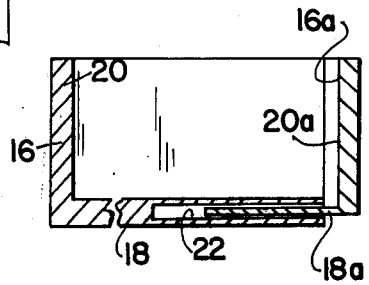
FIG. 4 is a sectional view taken along line 4—4 in FIG. 2.

Referring to FIG. 1 of the drawing and in accordance with the principles of the invention, a portable drawer assembly 10 is shown mounted to a chair 12. The assembly 10 may be used with any four legged piece of furniture that has a space between the legs 13 which are disposed rectangularly. The assembly 10 permits selective adjustment of the width of the drawer 14 to suit the piece of furniture beneath which it is mounted. The drawer 14 or enclosure is open at the top and is constructed of first and second sections 16, **16*a* that are engageable to one another. Each section 16, 16*a* has a rectangular base 18, 18*a* and three side walls 20, 20*a* each disposed perpendicular to its respective base 18, 18*a*. The base 18 and two side walls 20 of the first section 16 have slots 22 machined therein along the edges thereof that define an open side of the first section 16. The slot 22 is shown in FIG. 4. The base 18*a* and corresponding two side walls 20*a* of the second section 16*a* are configured to be slidably received in the slot 22. A set screw 24 in one or both of the slotted side walls 20 of the first section 16 can be driven to engage the corresponding side walls 20*a* of the second section and thereby maintain the two sections 16, 16*a* in a selected position corresponding to a desired width as shown in FIG. 3. A handle 26 is connected to one side wall 20 of the first section 16 for grasping to slide the drawer assembly 14** open or closed.

Figure 2:
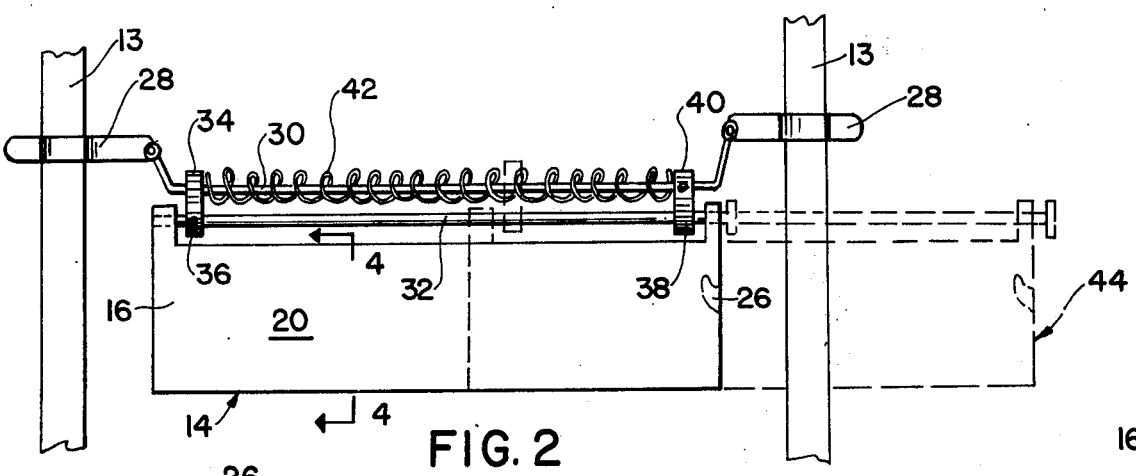
FIG. 2 is a partial side view.

The drawer assembly 14 is mounted between the four legs 13 of the chair 12 for sliding movement in the space between said legs 13. Connected to each leg 13 is a clamping member 28. Two first or fixed rods 30, **30*a* are connected between two clamping members 28 along the length of the enclosure 14. Two second or movable rods 32, 32*a* are connected at two sides 20, 20*a* of each section 16, 16*a* along the length thereof. Two first or rear connecting members 34, 34*a* are affixed with set screws 36 to its respective movable rod 32, 32*a* and is slidably connected to its respective fixed rod 30, 30*a* as shown in FIG. 2. Two second or front connecting members 38, 38*a* are affixed with set screws 40 to their respective fixed rods 30, 30*a* and are slidably connected to their respective movable rods 30, 30*a*. Surrounding each fixed rod 30, 30*a* and disposed between the rear connecting members 34, 34*a* and the front connecting members 38, 38*a* is a coil compression spring 42, 42*a* to bias the drawer 14 in a close position from an open position 44 shown in FIGS. 1 and 2**.

While the preferred embodiment of the invention is illustrated and described, it will be understood that the invention is in no way limited to this embodiment.

What is claimed is:

1. A portable drawer assembly for use with a four legged piece of furniture having a space between the legs, such as a chair or the like, said assembly comprising:

a. an enclosure having an open top and means for selectively adjusting the width thereof to effect the positioning thereof in the space between the four legs, said enclosure including first and second unitary sections each having a rectangular base and three side walls perpendicular thereto, said adjusting means including an integral slot in the base and two side walls of said first section along the open side thereof, the base and two side walls of said second section at the open side thereof being configured to be entirely slidably received in said integral slot; and b. means for moveably mounting the enclosure in suspension from the four legs for sliding movement of the enclosure into and out of said space between the four legs, a set screw in one of said two side walls of said first section for engaging the corresponding side wall of said second section to maintain the two sections in a selected position corresponding to a desired width, said mounting means comprising four clamping members for connecting to the four legs, two first elongated rods each connected between two clamping members along the length of the enclosure, two second elongated rods connected at two sides of the top of the enclosure along the length thereof and two sets of first and second connecting members, each set disposed at one side of the enclosure and suspending the same therefrom and wherein the first connecting member of each set is fixedly connected to one first rod and slidably connected to one second rod at the front of the enclosure and the second connecting member of each set is fixedly connected to one second rod and slidably connected to one first rod at the rear of the enclosure.

2. An assembly according to claim 1, wherein said mounting means further comprises two compression springs, each disposed between one set of first and second connecting members, said compression springs for urging said enclosure into a retracted position between said four legs.

3. An assembly according to claim 2, further comprising a handle connected to one sidewall of said first section corresponding to the front of the enclosure.

* * * * *